US005126705A

United States Patent [19]

Carnevali et al.

[11] Patent Number: 5,126,705

[45] Date of Patent: Jun. 30, 1992

[54] RF PARTITIONING NETWORK FOR ARRAY ANTENNAE

[75] Inventors: Nello Carnevali, Tivoli; Maurizio Cicolani; Antonio D. Novellino, both of Rome, all of Italy

[73] Assignee: Selenia Industrie Elettroniche Associate S.p.A., Rome, Italy

[21] Appl. No.: 557,308

[22] Filed: Jul. 23, 1990

[30] Foreign Application Priority Data

Jul. 21, 1989 [IT] Italy ..... 48224/89

[51] Int. Cl.[5] ..... H01P 5/12; H01P 3/08

[52] U.S. Cl. ..... 333/128; 333/246; 343/853

[58] Field of Search ..... 333/128, 246, 26, 238; 343/700 MS, 853, 813

[56] References Cited

U.S. PATENT DOCUMENTS

| | | | |
|---|---|---|---|
| 4,477,813 | 10/1984 | Weiss | 343/829 |
| 4,562,416 | 12/1985 | Sedivec | 333/246 |
| 4,631,494 | 12/1986 | Gould | 333/246 |
| 4,823,144 | 4/1989 | Guy | 343/853 |
| 4,829,309 | 5/1989 | Tsukamoto et al. | 343/700 MS |
| 5,019,829 | 5/1991 | Heckman et al. | 343/853 |

FOREIGN PATENT DOCUMENTS

| | | | |
|---|---|---|---|
| 0128001 | 10/1981 | Japan | 333/246 |
| 0190404 | 8/1988 | Japan | 333/246 |

*Primary Examiner*—Michael C. Wimer
*Assistant Examiner*—Peter Toby Brown
*Attorney, Agent, or Firm*—Cohen, Pontani, Lieberman & Pavane

[57] ABSTRACT

A lightweight mechanical structure is provided for supporting an RF partitioning network for a large dimension array antenna. The network consists of two horizontally disposed stripline RF dividing circuits positioned in two enclosed portions of the network. The network is formed within an enclosure which is made up of rigid side frames and electrically conductive ground planes between which the microwave stripline dividing circuit is formed. The ground plates of the stripline circuit are bonded to rigid honeycomb materials so as to provide structural support. The network is assembled by means of suitable structural adhesives. The structure of the partitioning network of the present invention provides for the RF feeding and mechanical support of large dimension array antennae in one assembly. The network requires a reduced number of tooling and finishing steps so as to achieve a low manufacturing cost while still providing good planarity and rigidity properties and reduced weight in a structure having large overall dimensions.

7 Claims, 2 Drawing Sheets

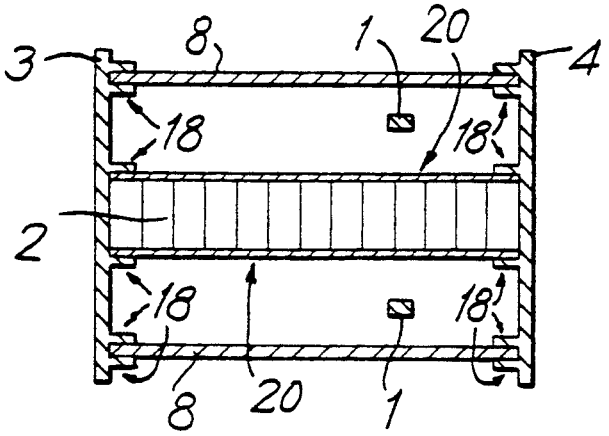
FIG. 1
FIG. 2
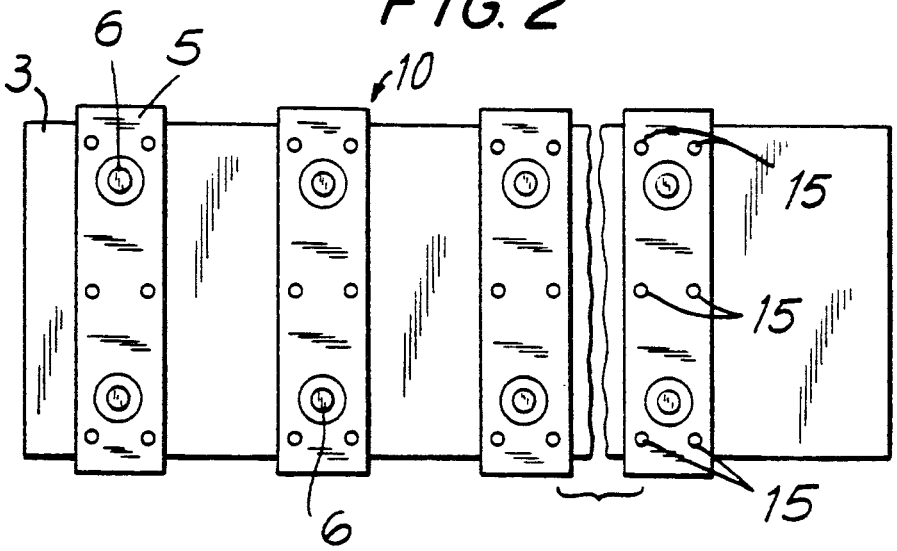

RF PARTITIONING NETWORK FOR ARRAY ANTENNAE

FIELD OF THE INVENTION

The present invention relates to an RF partitioning network particularly well-suited for large, lightweight array antennae. The invention forms the mechanical structure of the horizontal planes of the antenna while simultaneously forming the electrical circuits which feed the radiating elements in the horizontal planes of the array antenna. Array antennae as presently known in the art are made up of separate radiating elements which are fed by complex feed networks known as partitioning networks or, in some cases, beam forming networks. Typically, the circuits which make up the feed network make use of waveguides which offer certain advantages in terms of their ability to be flexibly configured with low power losses. These waveguide networks, however, possess a significant disadvantage for large arrays due to their considerable weight, dimension and cost. This is particularly troublesome in use of array antennae in applications where weight and space are at a premium.

The present invention is directed at providing an RF partitioning network for array antennae which, by combining the mechanical structural support for the partitioning network and the electrical circuit of the partitioning network in one rigid supporting structure, provides a compact, lightweight and economical network structure.

OBJECTS AND SUMMARY OF THE INVENTION

The present invention is directed to an RF partitioning network, or beam forming network, which is particularly well-suited for large lightweight array antennae, due to the particular composite metal structure adopted. The instant invention comprises a rigid, lightweight mechanical structure which supports the horizontal planes of the array antenna, while simultaneously forming within the structure an electrical circuit which feeds the radiating elements in the horizontal planes of the array antenna. The electrical circuit consists of two horizontally disposed dividing networks, one in each of two parts of the supporting structure. The mechanical portions of the structure are assembled by means of suitable structural bonding agents which are commonly used in the construction of electromechanical devices, particularly those used in antenna systems.

Presently known systems which utilize waveguides to form the dividing networks for the array antenna are not desirable for large installations, due to the considerable weight, dimensions and expense encountered building such dividing networks with waveguides. The present invention utilizes electrical circuits for the dividing network which are printed on dielectric substrates or photoetched on metal and supported by dielectric materials. Such circuits are commonly known as stripline circuits. Due to the configuration of the present invention and the materials adopted therein, the present invention provides a low weight, reduced cost, mechanically supportive structure which simplifies the manufacturing of dividing networks which can bear high peak power levels.

In the manufacturing of stripline RF network dividers such as those described above, it is known that critical care must be taken to adhere to the tight tolerances required to maintain the desired antenna characteristics. The structure of the present invention adopts modern manufacturing techniques to achieve ground planes between which the stripline is positioned. These ground planes consist of thin, aluminum skin panels which are placed above and below the respective stripline circuit in a manner known in the art. However, these aluminum panels are divided by a rigid honeycomb structure and bonded to this honeycomb structure by structural adhesives which are commonly available today or, in the alternative, may be produced by the antenna manufacturer himself.

These aluminum skin panels are simultaneously used to create the ground plates which surround the stripline circuit, and due to their being bonded to a rigid honeycomb structure, also simultaneously provide high planarity and rigidity characteristics required in the electromechanical manufacturing of RF dividing networks of this type. Additionally, the aluminum skin panels also are used to close the structure and provide for a completely sealed enclosure for the network.

It is therefore an object of this invention to provide an RF partitioning network which utilizes a portion of the housing of the electrical circuits which make up the RF network dividers to simultaneously form a rigid enclosure for the network that can support the mounting of antenna radiating elements and waveguide connectors on the network enclosure itself.

It is an additional object of this invention to provide such a combination structure which can be manufactured using known metal forming techniques and structural adhesives readily available on the market today.

It is a further object of this invention to provide such an RF partitioning network which is particularly suited to applications which require lightweight, reduced dimensions and reduced cost in a network which can also bear high peak power levels.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

DETAILED DESCRIPTION OF THE DRAWINGS

In the drawings, wherein like reference characters denote similar elements throughout the several views:

FIG. 1 is a side sectional view taken along section III—III of FIG. 3 showing the internal orientation of the stripline circuits and rigid supporting members of the present invention;

FIG. 2 is a front view of the RF partitioning network of the present invention showing the coupling interfaces for the radiating elements of the array antenna in horizontal planes;

DETAILED DESCRIPTION OF THE PRESENTLY PREFERRED EMBODIMENTS

Figure 4:
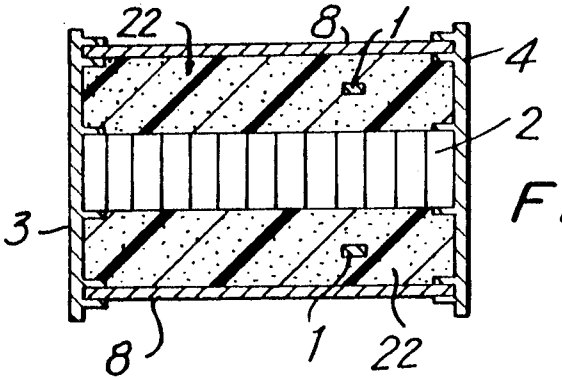
FIG. 4 is an embodiment utilizing dielectric foam to support the stripline circuit.
Figure 3:
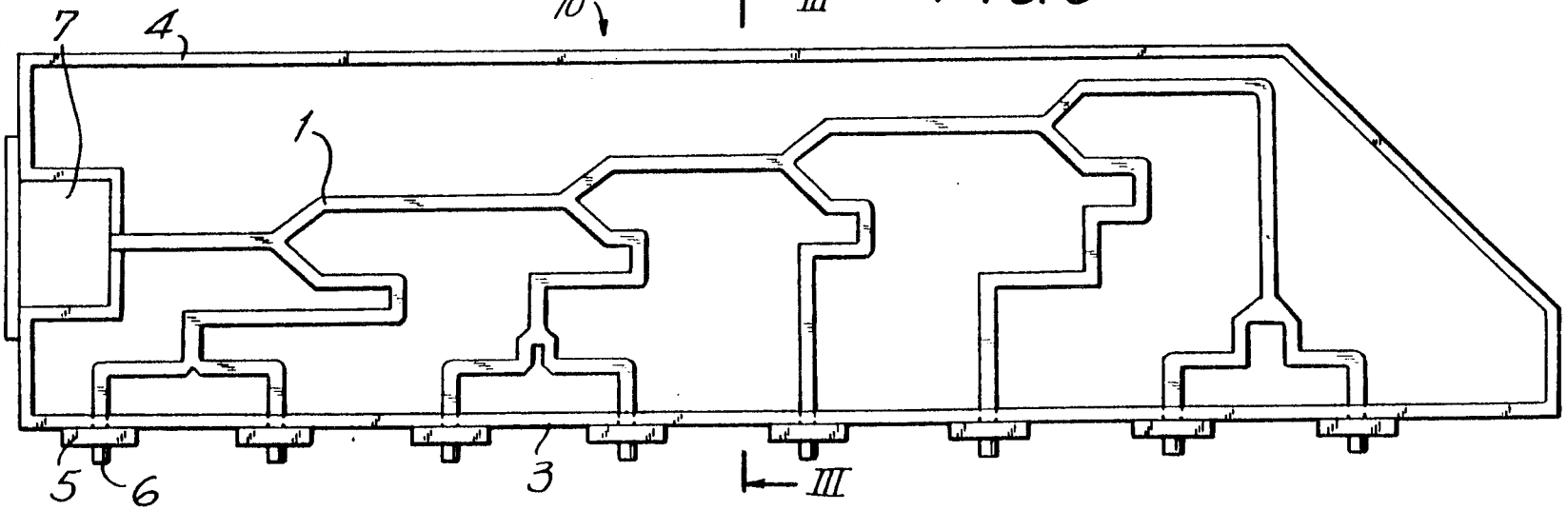
FIG. 3 illustrates a top view of the RF partitioning network of present invention showing a representative internal layout of the stripline circuit and the waveguide-stripline transition.

Referring now to the drawings in detail, and with initial reference to FIGS. I and 3, the RF partitioning network 10 is shown as a box-like enclosure made up of substantially rigid members 3 and 4 which form rigid opposing sides of the network 10, and electrically conductive planar members 8 which extend perpendicularly from rigid members 3 and 4 and which respectively form a third and fourth wall of the network 10. Extending centrally between the planar members 8 are electrically conductive planar partitions 20 which also extend perpendicularly from rigid members 3 and 4 and which extend into substantially parallel relation to planar members 8. The electrically conductive planar members 8 and electrically conductive planar partitions 20 are spaced apart to form three adjacent channels within the enclosure 10.

The rigid members 3 and 4 are preferably made of aluminum, and may be extruded or machined, as long as the resulting member is substantially rigid and impervious to outside elements and conditions typically found in antenna assemblies. At least one of the rigid members 3 or 4 is configured with coupling interfaces 5. These coupling interfaces provide both electrical and mechanical connections for the mounting of the radiating elements of the array antenna (not shown). The coupling interface may be mounted on the enclosure by the use of suitable screws mounted in screw holes 15, or through the use of adhesive bonding agents. The electrical connection may be through coaxial connectors 6.

The planar members 8 and the planar partitions 20 are made of aluminum material presently known in the construction of ground plates of microwave stripline circuits. Planar partitions 20 are bonded to a rigid aluminum honeycomb structure which forms a central support 2 for the network 10. Partitions 20 are bonded to honeycomb central support structure 2 by means of commonly known adhesives and bonding agents. The honeycomb central support structure 2, and the planar partitions 20 which have been bonded to it, are then in turn bonded to rigid members 3 and 4 via structural adhesives and electrically conductive elements which are presently known in the art. Additional support may be provided through the provision of mating grooves 18 formed in rigid members 3 and 4. Such traditional mechanical connecting devices and electrically conductive bonding agents, provided they are chemically compatible with the adhesives and materials adopted in the entire system, are used to obtain the required electromechanical connections between the partition walls 20, central support structure 2 and rigid support members 3 and 4. These elements can reasonably be assembled through an assembly jig which provides the required mechanical characteristics in terms of planarity, parallelism and perpendicularity which are the critical parameters of large antennae such as those contemplated for use with the present invention.

In the space formed between planar member 8 and planar partition 20 there is placed a suitable stripline circuit 1 which forms the required power splitting circuit of the RF partitioning network. Such an RF divider network comprised of stripline circuit 1, which may be printed or etched in accordance with the known techniques of forming stripline circuits, may be flexibly designed to meet the electrical characteristics required of the network to obtain the resultant desired beam formations of the array antenna being manufactured. Additionally, mode suppressors (not shown), if required, may be inserted into the stripline circuit 1 in a manner commonly known, to eliminate the problems of higher order modes which could arise due to the discontinuities naturally present in such stripline circuits 1. The stripline circuit 1 may be supported in proper position between planar members 8 and planar partitions 20, as shown in FIG. 4, through the use of low dielectric loss polyimide foam 22 having a suitable shape to obtain the required dielectric support of the stripline conductor of the stripline circuit 1 within the overall mechanical supporting structure formed by the rigid members 3 and 4, and the ground plates formed by planar members 8 and planar partitions 20. By assembling the network 10 in such a fashion, it can be seen that the structure forms the required electrical circuit while simultaneously providing a rigid mechanical support for the entire network.

The network 10, when assembled in accordance with the present invention, results in a complete enclosure which performs both electrical and mechanical functions. The enclosure may be constructed so as to be hermetically sealed and thereby render the internal electrical circuits invulnerable to external agents. A suitable waveguide to stripline circuit transition 7 is provided through one of the rigid members 3 or 4 of the network 10, through which the particular RF signals may be fed. Additionally, planar members 8, which serve to form two of the outside walls of the network 10, are formed in a fashion similar to the planar partitions 20 and central support 2. In other words, the planar members 8 are formed of electrically conductive planar sheets suitably bonded to an internal aluminum honeycomb structure for additional mechanical rigidity and support. Planar members 8 and planar partitions 20 may differ in thickness as needs require.

Therefore, it can be seen that the entire structure of the network 10 is developed so as to assure the provision of a suitable electrical divider network for an RF signal while at the same time providing a mechanical housing with excellent mechanical characteristics. Such a network is suitable for array antennas having large dimensions, while providing both low weight and a high capacity to bear high peak power levels. As can be seen, few mechanical tooling steps are required. Further, the network of the present invention can be made using off-the-shelf components, resulting in a final cost which is substantially lower than currently available systems. Through the use of lightweight honeycomb components for the structure, and low loss dielectric polyimide foams, the structure can be made much lighter than previous RF partitioning networks. This results in savings of materials for both the support of the array antenna and the components which comprise the RF divider network of the entire antenna itself, with the associated savings in cost.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, however, therefore, to be limited only as indicated by the scope of the claims appended hereto.

We claim:

1. A rigid, enclosed. RF array antenna partitioning network apparatus for operative connection between a microwave waveguide and microwave radiating elements, said apparatus comprising:

a polyhedron shaped enclosure having an outer surface and an inner surface;

a pair of oppositely facing substantially rigid members for forming respective first and second walls of said enclosure, each of said members having an outer surface which forms a portion of said outer surface of said enclosure and an inner surface which forms a portion of said inner surface of said enclosure;

a pair of flat, electrically conductive planar members of substantially equal dimension disposed in substantially parallel relation to each other and connected to and extending substantially perpendicularly from said inner surfaces of said rigid members, said planar members forming respective third and fourth walls of said enclosure;

a pair of flat, electrically conductive planar partitions of substantially equal dimension connected to and extending substantially perpendicularly between said inner surface of said rigid members and disposed in parallel relation to said planar members, said planar partitions and said planar members defining a first channel, a second channel, and a central channel between said first and second channels;

a pair of elongated, electrically conductive strips having a first end and a second end, said conductive strips extending within said first and second channels and defining therewith a microwave stripline circuit;

a substantially rigid filler member disposed within said central channel for providing mechanical rigidity to said central channel;

means for coupling said first end of said conductive strips to said microwave waveguide, said waveguide being mounted on said outer surface of said enclosure and extending through one of said rigid members; and means for connecting said second end of said conductive strips to said external radiating elements, said connector means mounted on said outer surface of said enclosure and extending through one of said rigid members.

2. The apparatus according to claim 1, wherein said rigid filler member comprises aluminum honeycomb shaped filler material.

3. The apparatus according to claim 1, wherein aid first and second chambers are filled with a dielectric material.

4. The apparatus according to claim 3, wherein said dielectric material comprises low dielectric loss polyimide foam.

5. The apparatus according to claim 1, wherein said enclosure is hermetically sealed.

6. The apparatus according to claim 2, wherein said honeycomb shaped filler material is adhesively bonded to said planar partitions.

7. The apparatus according to claim 1, wherein said planar members and said planar partitions are connected to said rigid members via adhesive bonding.

* * * * *